US007608025B1

(12) United States Patent
Best

(10) Patent No.: US 7,608,025 B1
(45) Date of Patent: Oct. 27, 2009

(54) COMPACT EXERCISE AND STRENGTH MEASURING DEVICE

(76) Inventor: Martin C. Best, 8101 Stonebrook Ter., #103, Raleigh, NC (US) 27603

( * ) Notice: Subject to any disclaimer, the term of this patent is extended or adjusted under 35 U.S.C. 154(b) by 0 days.

(21) Appl. No.: 12/326,931

(22) Filed: Dec. 3, 2008

Related U.S. Application Data

(60) Provisional application No. 61/125,857, filed on Apr. 30, 2008.

(51) Int. Cl.
*A63B 21/02* (2006.01)

(52) U.S. Cl. ..... 482/123; 482/142; 482/148

(58) Field of Classification Search ..... 482/148, 482/121–130, 1–9; 177/177; D10/87; 705/416; 40/458; 414/21
See application file for complete search history.

(56) References Cited

U.S. PATENT DOCUMENTS 3,785,644 A * 1/1974 Bradley et al. ..... 482/127
4,660,828 A * 4/1987 Weiss ..... 482/123
6,149,550 A 11/2000 Shteingold
6,575,567 B2 6/2003 Carroll et al.
6,612,170 B2 9/2003 Brown
6,652,432 B2 * 11/2003 Smith ..... 482/146

* cited by examiner

*Primary Examiner*—Lori Amerson
(74) *Attorney, Agent, or Firm*—Coats & Bennett, P.L.L.C.

(57) ABSTRACT

An exercise device that may be used to perform multiple different exercises. The exercise device may include a scale with a base plate positioned on a bottom side of the scale and a contact plate positioned on a top side of the scale. Bands may be attached to and extend from the base plate. The exercise device may be placed on a support floor with the user on the contact plate and the scale and the base plate underneath. The user may be able to perform multiple different exercises by pulling against the bands. The scale may be operative to measure a force applied by the user to the contact plate. The scale may include a display for the user to monitor the amount of force while performing the exercises.

7 Claims, 9 Drawing Sheets

COMPACT EXERCISE AND STRENGTH MEASURING DEVICE

This application claims priority from U.S. Provisional Application No. 61/125,857, filed Apr. 30, 2008, which is incorporated herein by reference.

BACKGROUND

There are numerous different exercise devices currently available today on the market. Many of these devices are quite large with extensive frames that may include benches, weights, pulleys, and racks. These devices require a significant amount of floor space both to accommodate the device itself and for the user to perform the various exercises. These types of devices are not practical for most people who do not have the space to accommodate such a large device. These devices usually require a separate room which is just not available for many potential users. Further, these large devices cannot be stored in available space such as under a bed or in a closet when not in use.

In addition, many exercises devices are constructed for a single exercise and are not applicable for performing multiple different exercises. Therefore, the user is required to purchase and maintain multiple separate devices in order to have a full workout of multiple body parts. Further, these large devices are expensive. Initially, the device may cost thousands of dollars to purchase. Afterwards, the user may be required to purchase an on-going maintenance program to ensure the device is operating properly. Also, the device may include numerous moving parts that may break during use which may require additional repair costs.

Thus, there remains a need for alternative exercise and/or strength measurement devices that address one or more of the issues above.

SUMMARY

The present application is directed to an exercise device that can be used with multiple different exercises. The exercise device is relatively small to facilitate storing when not in use. The exercise device may include a scale with a base plate positioned on a bottom side of the scale and a contact plate positioned on a top side of the scale. Bands may be attached to the base plate and extend a distance away therefrom. The exercise device may be placed on a support floor so that the user is positioned on the contact plate with the scale and the base plate underneath. The user may be able to perform multiple different exercises by pulling against the bands. The scale may be operative to measure a force applied by the user to the contact plate. The scale may include a display for the user to monitor the amount of force while performing the exercises.

The various aspects of the various embodiments may be used alone or in any combination, as is desired.

DETAILED DESCRIPTION

The present application is directed to an exercise device for performing multiple different exercises. The exercise device advantageously has a compact size for use in relatively small spaces. The compact size also facilitates storage when the device is not in use.

Figure 1:
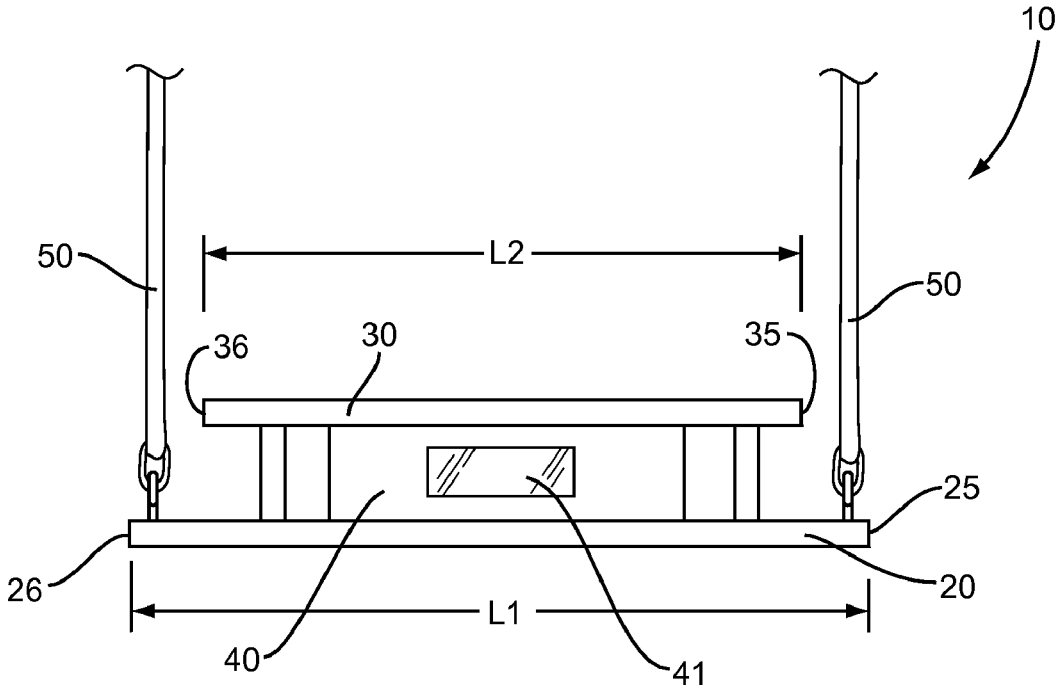
FIG. 1 is a schematic side view of an exercise device according to one embodiment.

FIG. 1 schematically illustrates an exercise device 10 that includes a base plate 20, contact plate 30, scale 40, and bands 50. The scale 40 is positioned between the base plate 20 and contact plate 30. The contact plate 30 is movable relative to the base plate 20 with movement towards the base plate 20 registering on the scale 40. Bands 50 are attached to the base plate 20 and are configured to be manipulated by the user. In use, the user stands on the contact plate 30, with the scale 40 and base plate 20 underneath. The user applies a lifting force to the bands 50 that forces the contact plate 30 downward toward the base plate 20 with the resulting force being registered by the scale 40. The scale 40 includes a display 41 for the user and/or others to observe the amount of force being applied towards the base plate 20. In some embodiments, the display 41 is remotely located relative to scale 40, and advantageously connected thereto by a suitable flexible cable 44.

Figure 2:
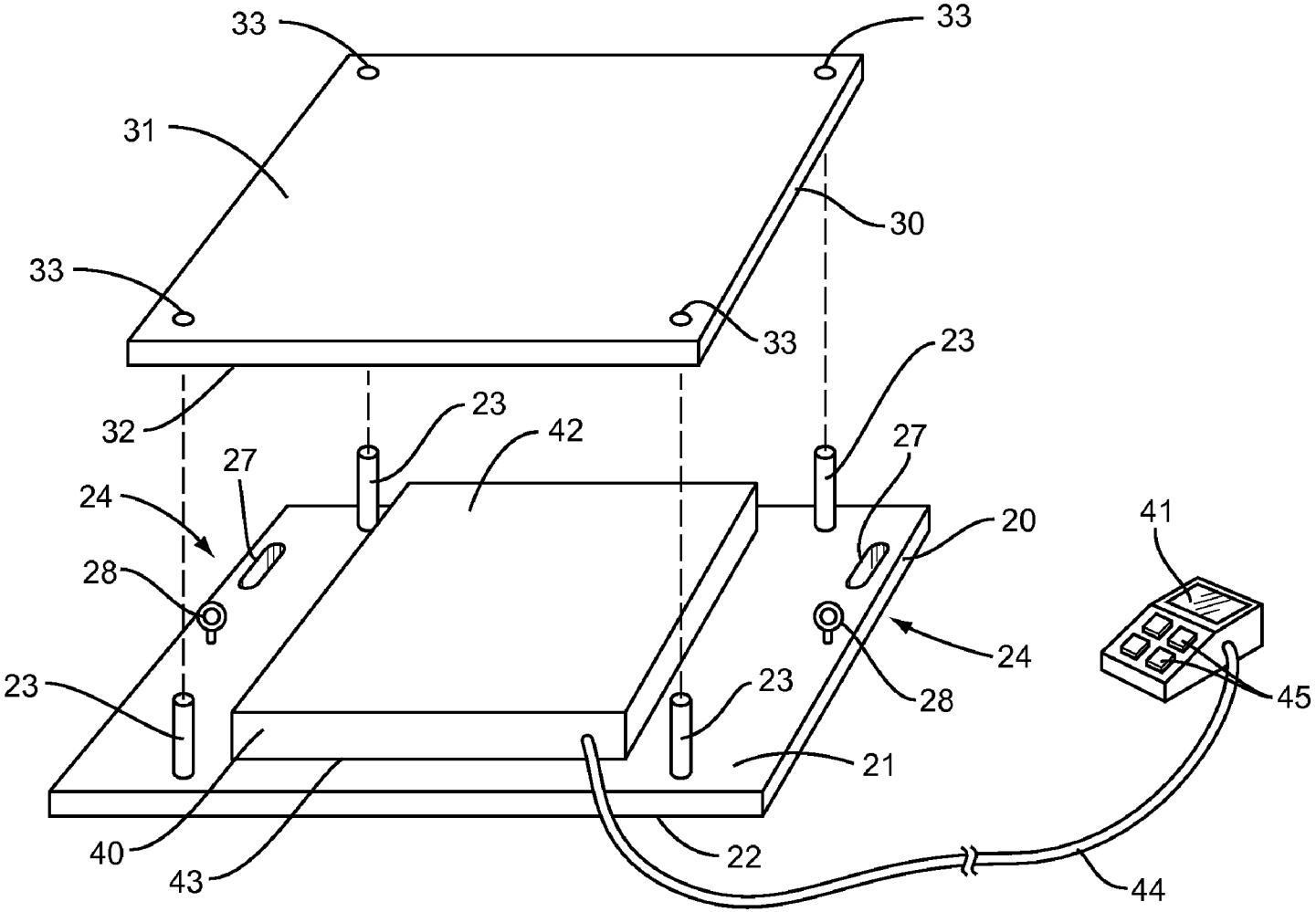
FIG. 2 is a partially exploded perspective view of a base plate, contact plate, and scale according to one embodiment.

FIG. 2 shows an exploded view with the base plate 20 and scale 40 removed from the contact plate 30. The base plate 20 includes a first (upper) side 21 that faces towards the scale 40 and an opposite second (lower) side 22. The contact plate 30 includes a first (upper) side 31 that is contacted by the user, and a second (lower) side 32 that faces towards the scale 40. The shapes and sizes of the base plate 20 and the contact plate 30 may vary as is desired. Advantageously, both base plate 20 and contact plate 30 are rigid to form a firm support for the user, and an accurate means to register the force applied by the user. The base plate 20 and contact plate 30 may be constructed from relatively light-weight materials to facilitate moving and storing the device 10. Materials include but are not limited to aluminum, steel, reinforced polymers, and the like. The base plate 20 and contact plate 30 may be constructed of the same or different materials. Further, the thickness measured between the sides 21, 22 and 31, 32 may vary depending upon the materials. In one embodiment, the base plate 20 and contact plate 30 are formed of ⅜ inch thick type 5052 aluminum.

Figure 3:
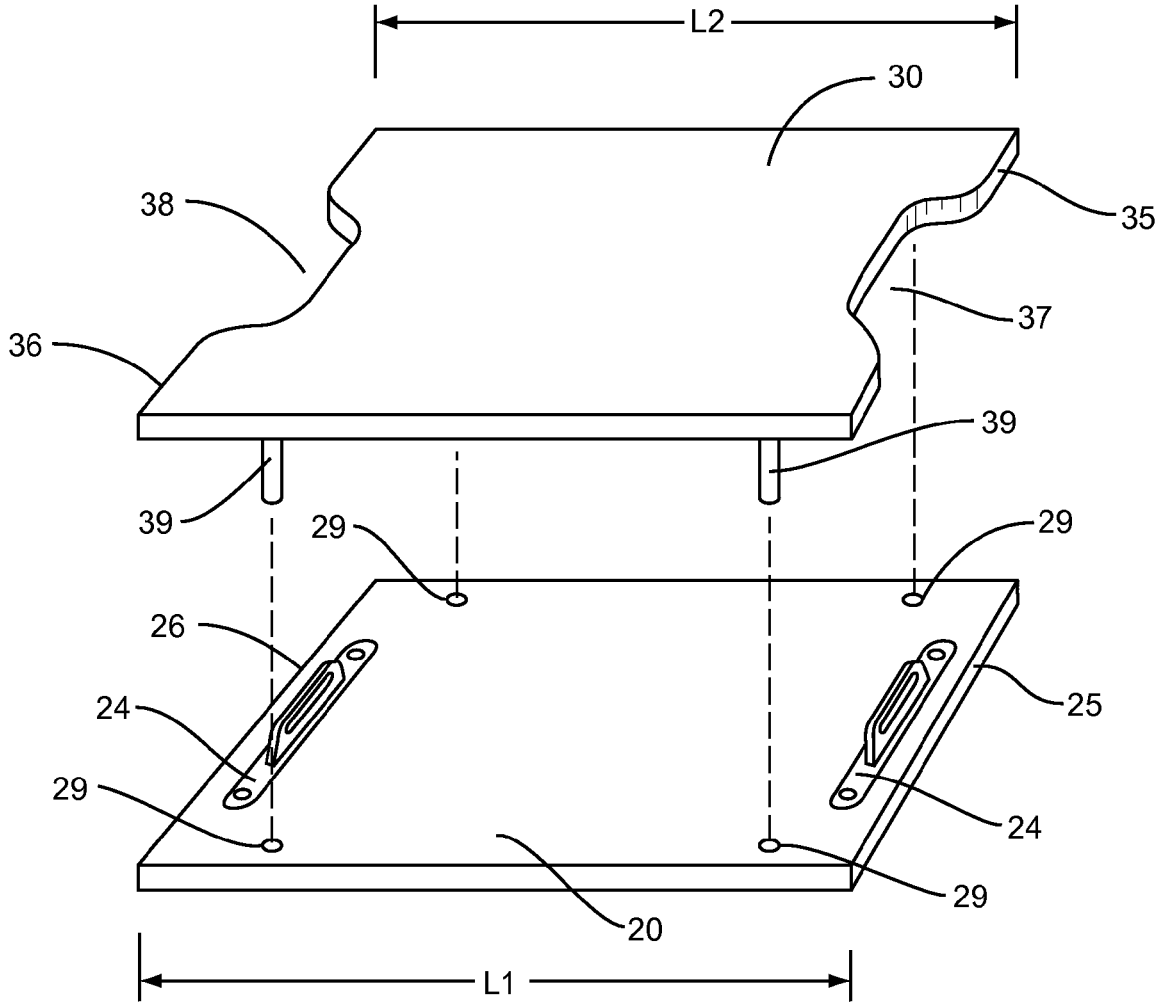
FIG. 3 is a partially exploded perspective view of a base plate and a contact plate according to one embodiment.

The contact plate 30 and the base plate 20 may be coupled together in any suitable fashion that allows for contact plate 30 to move towards base plate 20 so as to register the force being applied by the user. Advantageously, the coupling allows for movement together and apart, but limits or prevents lateral movement of contact plate 30 relative to base plate 20. Various guiding members may be used to attach the plates 20, 30. The base plate 20 of FIG. 2 includes guide rails 23 that extend upward from the base plate first side 21 and are slidably received in corresponding apertures 33 in contact plate 30. Various numbers of rails 23 and apertures 33 may be located about the plate 20, 30. For example, FIG. 2 includes the rails 23 and apertures 33 substantially positioned in the four corners of the plates 20, 30, but such is not required in all embodiments. In other embodiments, the rails may be associated with contact plate 30 and be moveable relative to base plate 20. For example, FIG. 3 shows rails 39 that extend downward from contact plate 30 to be received that in apertures 29 in base plate 20. Alternative configurations of guiding members may also include sidewalls that extend along the periphery of one of the plates 20, 30; such sidewalls may be positioned to allow the opposing plate 20, 30 to fit within the interior of the sidewalls and move into and away in a telescoping manner.

Figure 5:
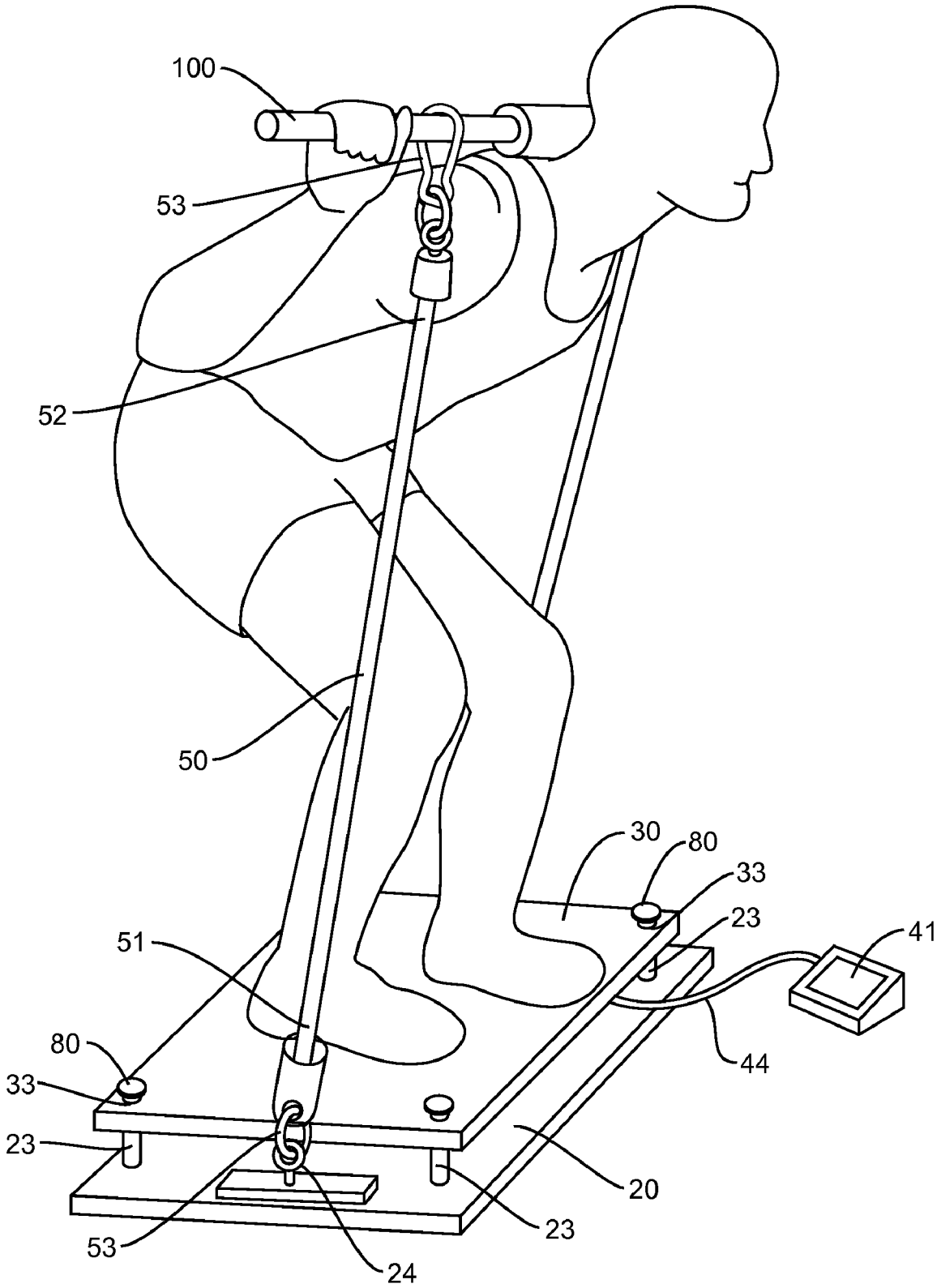
FIG. 5 is a perspective view of an exercise device used for an exercise according to one embodiment.

Retainers or locks 80 may be positioned at the ends of the guide members to maintain the contact plate 30 attached to the base plate 20. FIG. 5 includes locks 80 positioned at the ends of rails 23. The locks 80 include a larger width than the apertures 33 in the contact plate 30. This configuration prevents the contact plate 30 from being detached from the base plate 20, especially while the user is performing an exercise. In one embodiment, the locks 80 are threaded onto the rails 23. After use, the locks 80 may be unthreaded to allow removal/disassembly of contact plate 30 from base plate 20.

The base plate 20 may further include connectors 24 to attach to the bands 50. One type of connector 24 includes an eye-bolt 28 as illustrated in FIG. 2 with a first section embedded within the base plate 20, and an eyelet for receiving one of the bands 50. Another connector 24 may include an aperture 27 that extends through the base plate 20 and is sized to receive the band 50. The base plate 20 may include various numbers and types of connectors 24. The different types and positioning of connecting means may provide for attaching different types of bands 50 and/or allow for attaching the bands 50 differently for different exercises. By way of example, FIG. 4 includes multiple connectors 24 extending along the sides of the base plate 20. A first pair of connectors 24 may be used for a bench-press exercise, and a second pair of connectors 24 may be used for an overhead lift exercise.

Figure 4:
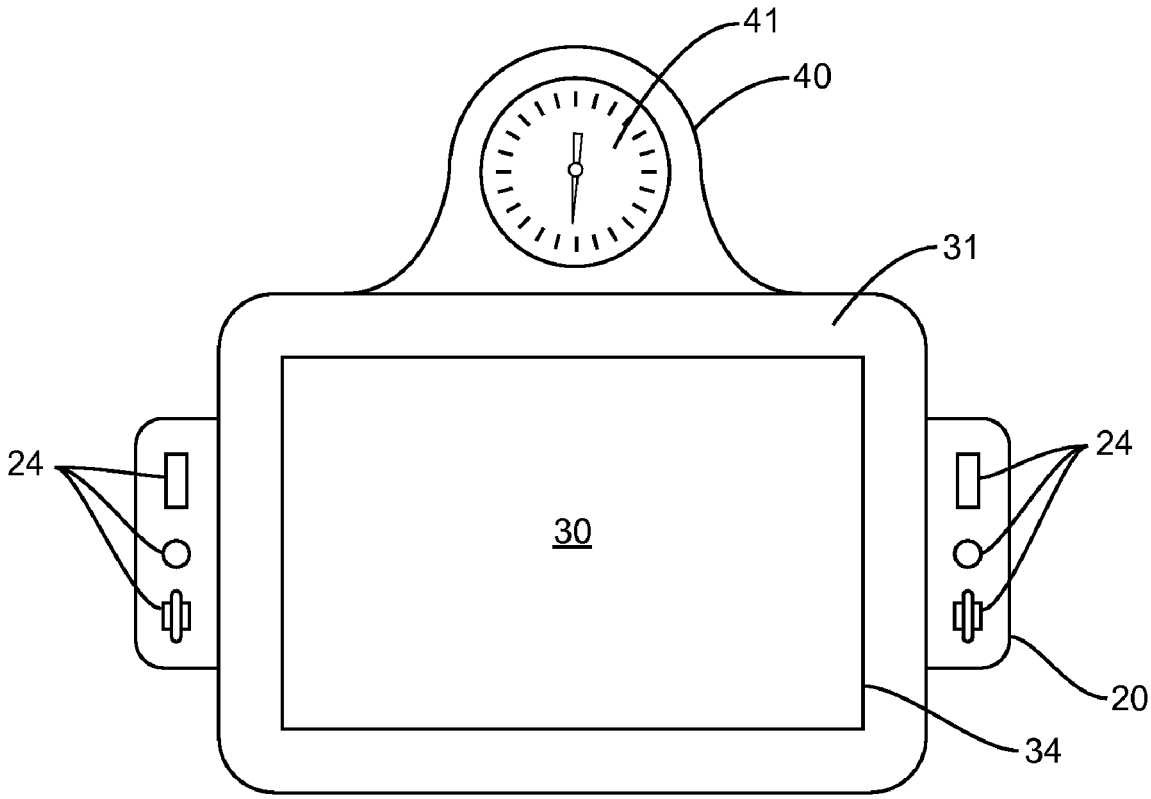
FIG. 4 is a top view of a display of a scale extending outward beyond a contact plate according to one embodiment.

The contact plate 30 is positioned over the scale 40 and base plate 20. A contact surface 34 may extend across at least a section of the first side 31 as illustrated in FIG. 4. The contact surface 34 may include a frictional surface to prevent the user from slipping. The contact surface 34 may also include indicators to direct the user where to position their feet or equipment on the contact plate 30 to properly perform an exercise.

The contact plate 30 may be sized relative to the base plate 20 to prevent interference with the bands 50. FIG. 1 includes the contact plate 30 being sized to prevent interference. The length L2 of the contact plate 30 measured between opposing sides 35, 36 is smaller than the length L1 of the base plate 20 measured between opposing sides 25, 26. The connectors 24 are positioned towards the sides 25, 26 of the base plate 20 and are advantageously disposed outboard of the sides 35, 36 of the contact plate 30. This sizing and positioning of the contact plate 30 allows use of the bands 50 by the user without interfering with the contact plate 30.

The contact plate 30 may be smaller in size than base plate 20 and be positioned to completely overlap with base plate 20 in such a fashion as to fit within the horizontal footprint of base plate 20. FIG. 5 shows one embodiment with complete overlap of contact plate 30. Alternatively, the size and/or positioning of the contact plate 30 may be such that one or more sections thereof do not overlap with the base plate 20.

The contact plate 30 may also include a shape to prevent interference with the bands 50. The contact plate 30 of FIG. 3 includes cut-outs 37, 38 in the contact plate 30 that align with the connectors 24 on the base plate 20. The cut-outs 37, 38 prevent interference with the bands (not illustrated in FIG. 3) even with the overall length L2 of contact plate 30 being substantially equal to the length L1 of base plate 20.

The scale 40 is positioned between the base plate 20 and contact plate 30. The scale 40 includes a first (upper) side 42 that faces contact plate 30 and a second (lower) side 43 that faces base plate 20. The scale 40 may be in direct contact with contact plate 30 and base plate 20. Alternatively, an intermediate member (not illustrated) may be positioned between scale 40 and one or both plates 20, 30. The scale 40 may be completely positioned between plates 20, 30, or may be sized and/or positioned to extend partially outward from between plates 20, 30.

Figure 6:
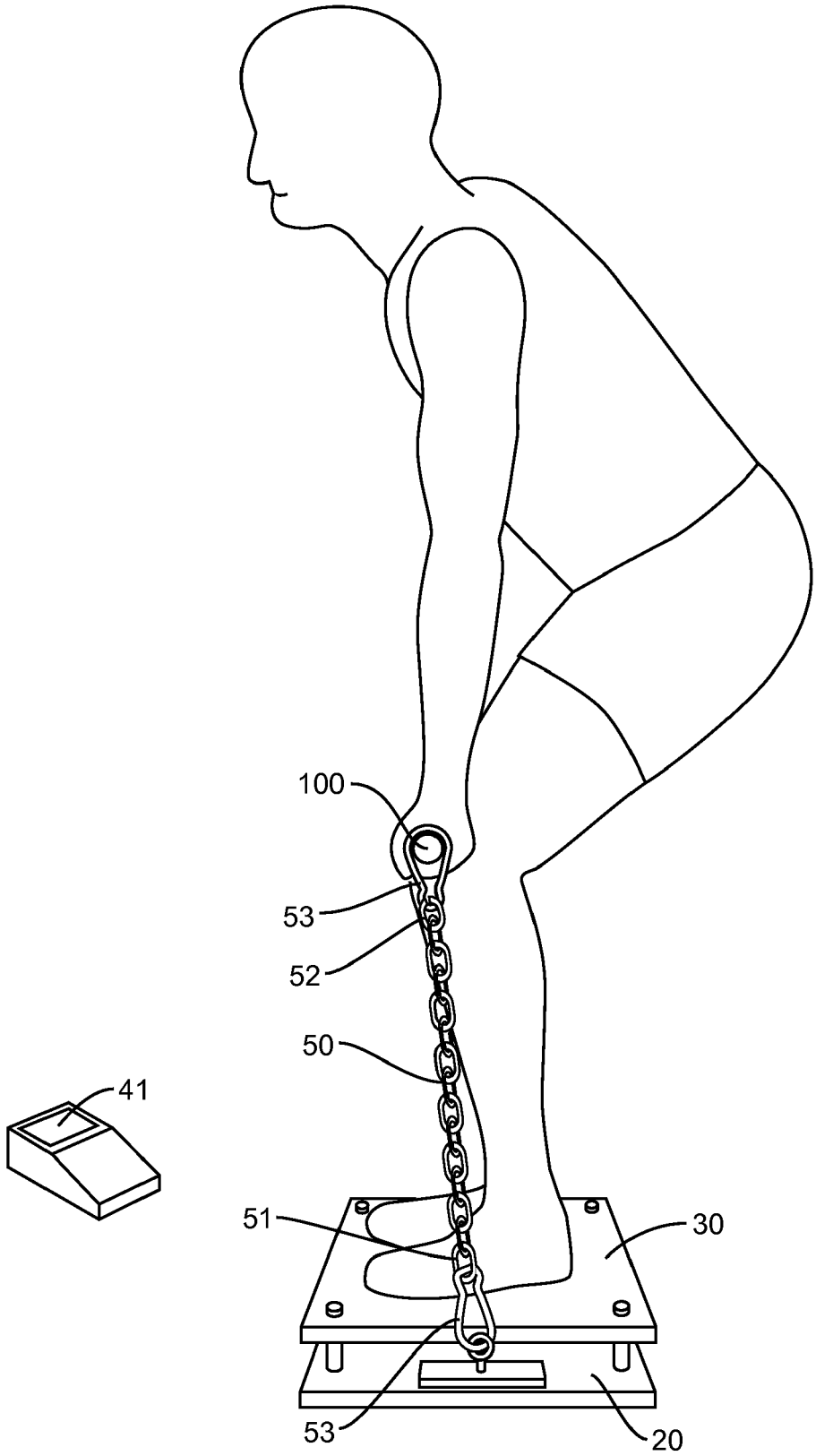
FIG. 6 is a perspective view of an exercise device used for an exercise according to one embodiment.

The scale 40 has an associated display 41 that displays the amount of force being applied by the user. The display 41 may include an LCD or LED display that is able to display one or more lines of numbers, letters of the alphabet, and symbolic characters. The display 41 may further include one or more input buttons 45 for toggling between units of measure (e.g., pounds and kilograms), or to view previously stored data, or to set a tare value. The display 41 may also include a timer for the user to observe while performing the exercises. In some embodiments, the scale 40 and/or display 41 may be operative to retain and display a maximum force detected between resets. The display 41 is advantageously positionable by the user at various locations for observation while performing the exercises. For example, it may be desirable to position the display 41 at approximately eye-level for the user, so that it may be viewed without having the user look down during the exercise/test. In one example, shown in FIG. 2, the display 41 is remote from scale 40, with a cord 44 connecting display 41 to scale 40. The display 41 may also or alternatively communicate wirelessly with the scale 40 to allow for remote positioning, as illustrated in FIG. 6. In alternative embodiments, such as that in FIG. 4, the display 41 may be integral with scale 40 and extend outward from beyond the contact plate 30. The display 41 may include a rotating needle and numerical indicators, as is desired. In some embodiments, the scale 40 does not include a display 41.

Figure 7:
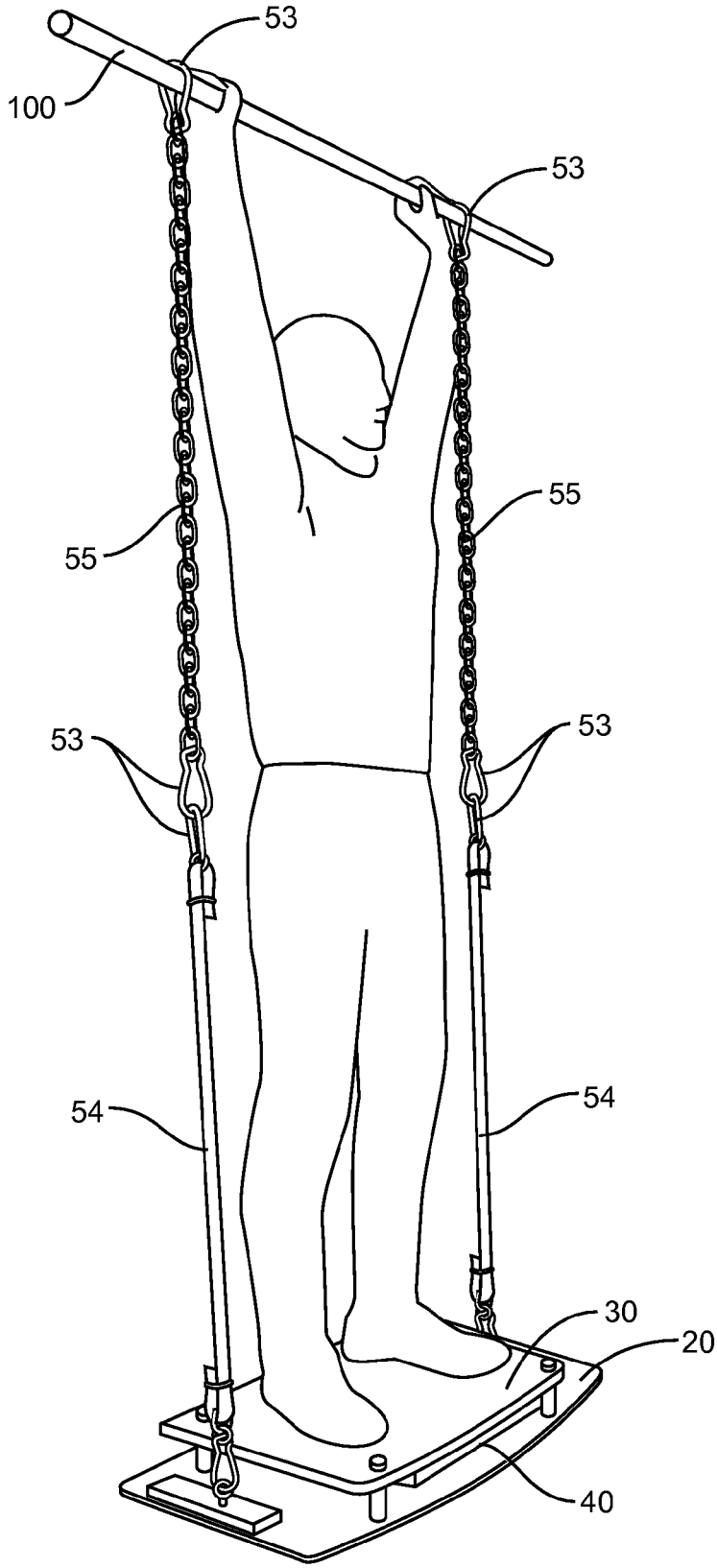
FIG. 7 is a perspective view of an exercise device used for an exercise according to one embodiment.

The bands 50 include first and second ends 51, 52, with the first end 51 attached to base plate 20 and the second end distally disposed for grasping by the user or attachment with a second band. The bands 50 have a length measured between the ends 51,52, which may vary depending upon the specific exercise and the size of the user. The bands 50 may be constructed from a variety of different materials and may be either elastic or inelastic. Examples of elastic bands include rubber or similar elastic polymers, springs, bungee cords, and the like that have significant elastic properties. Examples of inelastic bands include, chains, sizable ropes, and the like that, while flexible and non-self supporting when disposed in cantilever fashion, nonetheless are of relatively constant length for the relevant magnitude of forces encountered in this application. The bands 50 may also include multiple different sections. FIG. 7 includes bands 50 with a first section 54 with a first construction, and a second section 55 with a different second construction. Specifically, FIG. 7 includes the first section 54 constructed from a non-expandable cord and the second section 55 constructed from a chain.

Couplers 53 may be positioned at one or both ends 51, 52 to attach the bands 50 to the base plate 20 and/or a bar 100. The couplers 53 associated with first end 51 are configured to attach to base plate connectors 24, while couplers 53 associated with the second end 52 are configured to attach with a bar 100 or hand grips. Further, couplers 53 may be used to daisy-chain together different sections 54, 55 as illustrated in FIG. 7. The couplers 53 may be configured to move between locked and unlocked positions. In unlocked positions, the couplers 53 may be attached and removed from the base plate 20, bar 100, and other sections of the band 50. The couplers 53 may be locked prior to performing the exercise. One example of a coupler 53 includes a carabiner-type coupler with a metal loop and a sprung or screwed gate.

Figure 8:
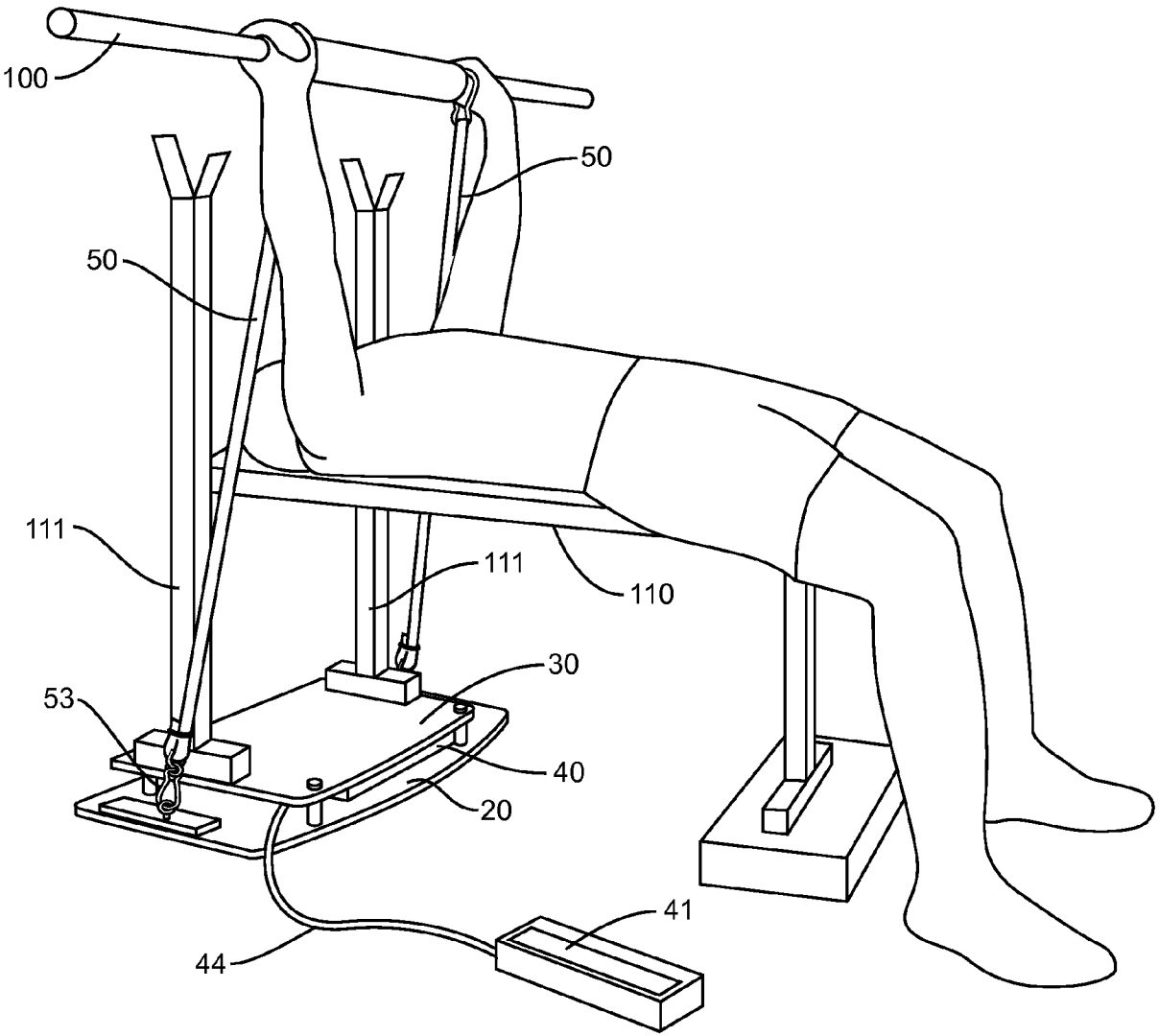
FIG. 8 is a perspective view of an exercise device used for an exercise according to one embodiment.
Figure 9:
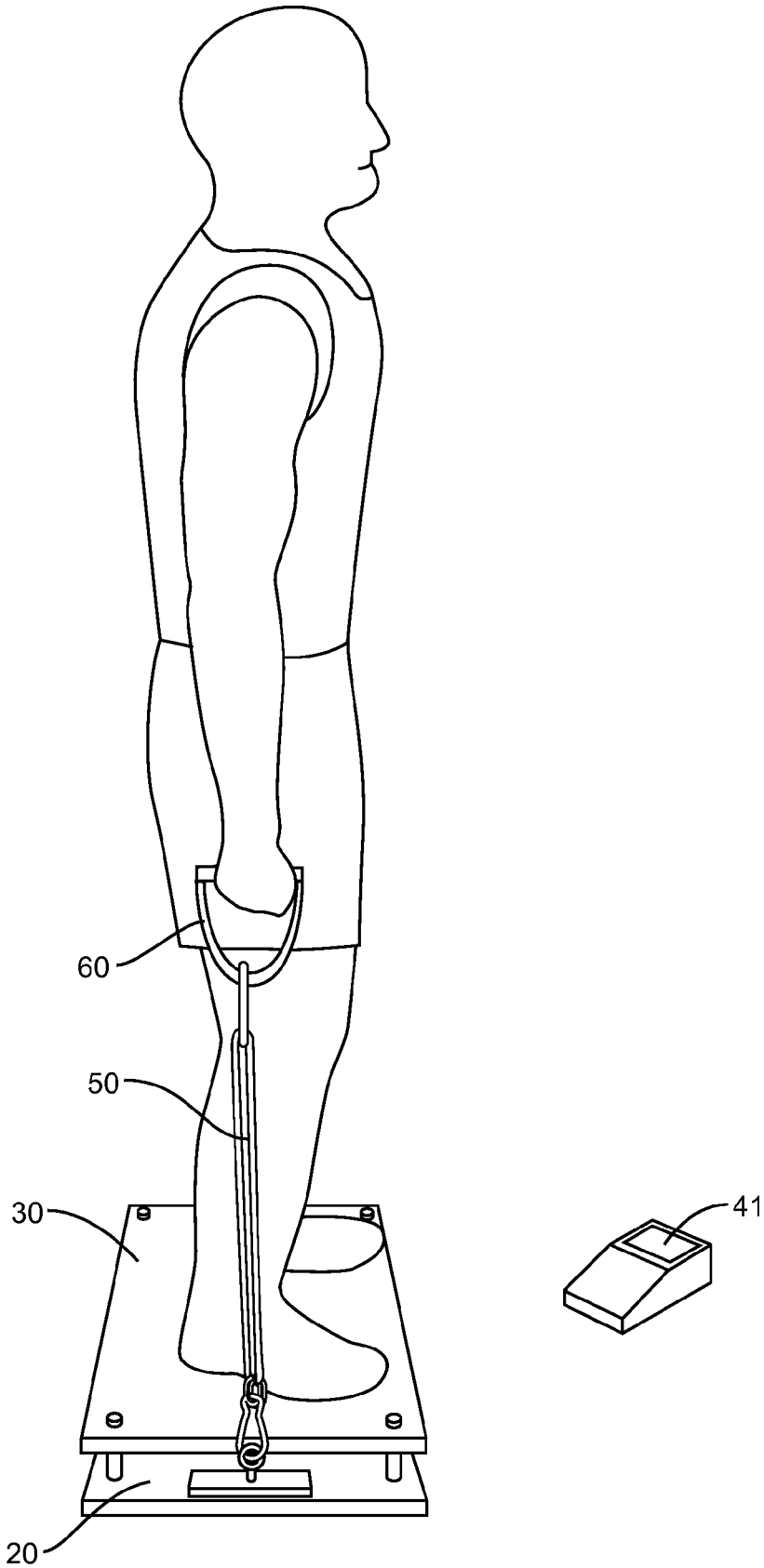
FIG. 9 is a perspective view of an exercise device used for an exercise according to one embodiment.

As shown in FIGS. 5-8, a bar 100 may be attached to the second end 52 of the bands 50 for performing various exercises. In these embodiments, a coupler 53 at the second ends 52 includes a loop sized to receive the bar 100. Alternatively, handles 60 may be attached to the second ends 52 for grasping by the user as illustrated in FIG. 9. The bars 100 and handles 60 may be quickly detached and replaced from the second ends 52 during a workout with limited interruption.

The bands 50 may also include markings (e.g., color coding, numerals, etc.) along the length at various intervals. The markings provide a visual reference for the user to position bar 100 or handles 60 at the proper distance from base plate 20. The markings may also ensure the different bands 50 include the same length.

The number and positioning of the bands 50 may vary depending upon the exercise. For many exercises, two bands 50 are attached to the base plate 20 on opposing sides of the contact plate 30. Other exercises may require a single band, or three or more bands 50. Some exercises may also require bands 50 to be positioned on the same side of the contact plate 30.

In use, the device 10 is positioned in an area that is adequate for performing the intended exercise or exercises. The base plate 20 is positioned on a floor with the scale 40 and contact plate 30 disposed in an overlapping configuration. The user may also position the display 41 at a location where it can be seen while performing the exercise. The user attaches the bands 50 of the appropriate length to the base plate 20 for the intended exercise, and attaches the bar 100 or handles 60 to the second ends 52.

The user steps onto the contact plate 30 and positions their feet onto the contact surface 34 while holding the bar 100 or handles 60. The user then advantageously sets the tare weight on the scale and begins the exercise by applying a force to the bands 50. This force causes the contact plate 30 to be forced downward with this downward force being registered by the scale 40. The user may watches the display 41 during the exercise to observe the amount of force being applied to the bar 100. Some exercises are isometric with the user applying a force while maintaining a static position without changing their joint angle and muscle length. The user may watch the display and apply the force for a given amount of time while maintaining the same physical position.

The user may maintain the same set-up with the same bands 50 and bar 100 or handles 60 to perform various sets of the exercise. The user may also change the set-up by changing the type or length of the bands 50 and/or the bar 100 or handle 60. This may include removing the attached bands 50 from the base plate 20 and replacing them with different bands 50. Once the change is complete, the user may advantageously reset the tare and perform the new exercise. The user may keep changing the set-up to perform various types of exercises.

In the various embodiments, the user stands directly on the contact plate 40 as illustrated in FIGS. 5-7 and 9. The device 10 may also be used with a bench 110 as illustrated in FIG. 8. The user aligns the bench 110 with legs 111 placed onto the contact plate 30. The user is then able to perform various exercises while lying on the bench and moving the bar 100 away from the contact plate 30. For example, FIG. 8 illustrates the user performing a bench press exercise. Other exercise may also be applicable while laying or sitting on the bench.

Typically, the user may zero-out the scale 40 (set tare) prior to beginning the exercise. This includes the user attaching the appropriate bands 50 and bar 100 or handle 60 to the base plate 20. The user then holds the bar 100 or handle 60 and bands 50 and stands onto the contact plate 30. The scale 40 measures the weight of the user, bands 50, and bar 100 or handle 60. While remaining on the contact plate 30, the user may adjust the display 41 to zero (set tare). The user may then start the exercise with the display indicating just the amount of force being applied. This same zeroing-out process may also used for exercises with the bench 110.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An exercise device comprising:

a base plate;

a contact plate positioned in an overlapping orientation with the base plate;

guide members that extend outward from at least one of the base plate and the contact plate to moveably couple the base plate to the contact plate, the guide members configured to guide movement between the contact plate and the base plate towards and away from each other;

bands attached to the base plate that have a length to extend above the contact plate;

a scale positioned between the base plate and the contact plate and configured to measure a force at which the contact plate is urged towards the base plate.

2. The exercise device of claim 1 wherein the contact plate is smaller than the base plate and fits within a horizontal footprint thereof.

3. The exercise device of claim 1 wherein the bands are attached to the base plate at connection points disposed outboard of the contact plate.

4. The exercise device of claim 1 wherein the guide members include pegs that extend from one of the base plate and the contact plate and fit within apertures in the other of the base plate and the contact plate.

5. The exercise device of claim 4 further comprising retainers on the guide members that prevent the contact plate from being decoupled from the base plate.

6. The exercise device of claim 1 wherein the guide members are configured to inhibit relative lateral movement between the base plate and the contact plate.

7. The exercise device of claim 1 wherein the scale further includes a display to display the force at which the contact plate is urged towards the base plate.

* * * * *